US005125680A

United States Patent [19]

Bejean et al.

[11] Patent Number: 5,125,680

[45] Date of Patent: Jun. 30, 1992

[54] DEVICE FOR BINDING A SHOE OR BOOT TO A CROSS-COUNTRY SKI

[75] Inventors: Alain Bejean, Alby Sur Cheran; Ivan Thevenin, Foncine Le Haut, both of France

[73] Assignee: Salomon S.A., Chavanod, France

[21] Appl. No.: 655,196

[22] Filed: Feb. 14, 1991

Related U.S. Application Data

[63] Continuation of Ser. No. 388,496, Aug. 2, 1989, abandoned.

[30] Foreign Application Priority Data

Aug. 3, 1988 [FR] France ..... 88 10494

[51] Int. Cl.[5] ..... A63C 9/00

[52] U.S. Cl. ..... 280/615; 280/11.14; 280/602; 280/605; 280/607; 280/636

[58] Field of Search ..... 280/604, 605, 615, 607, 280/11.15, 11.14, 636, 842, 602

[56] References Cited

U.S. PATENT DOCUMENTS

| | | | |
|---|---|---|---|
| 2,844,380 | 7/1958 | Tribelhorn | 280/604 |
| 3,260,531 | 7/1966 | Heuvel | 280/602 |
| 3,260,532 | 7/1966 | Heuvel | 280/602 |
| 3,326,564 | 6/1967 | Heuvel | 280/602 |
| 4,219,216 | 8/1980 | Settembre | 280/615 |
| 4,678,200 | 7/1987 | Powell | 280/607 |

FOREIGN PATENT DOCUMENTS

| | | | |
|---|---|---|---|
| 0230989 | 8/1987 | European Pat. Off. . | |
| 2259375 | 6/1974 | Fed. Rep. of Germany | 280/602 |
| 2412278 | 9/1975 | Fed. Rep. of Germany . | |
| 3040253 | 5/1981 | Fed. Rep. of Germany | 280/615 |
| 3334488 | 3/1984 | Fed. Rep. of Germany | 280/604 |
| 399364 | 6/1909 | France | 280/615 |
| 2595577 | 9/1987 | France . | |
| 433850 | 4/1948 | Italy | 280/636 |
| 440597 | 10/1948 | Italy | 280/607 |
| 546355 | 4/1977 | U.S.S.R. | 280/11.14 |

*Primary Examiner*—Eric D. Culbreth

*Attorney, Agent, or Firm*—Sandler, Greenblum & Bernstein

[57] ABSTRACT

System for binding a shoe or boot onto a cross-country ski. The system includes an upper support plate which is movably mounted along a direction having a component which is substantially perpendicular to the ski. The system further includes an elastic means for elastically biasing the movable support plate in a direction separating it from the ski.

25 Claims, 3 Drawing Sheets

DEVICE FOR BINDING A SHOE OR BOOT TO A CROSS-COUNTRY SKI

CROSS-REFERENCE TO RELATED APPLICATION

This application is a continuation of U.S. Application Ser. No. 07/388,496, filed on Aug. 2, 1989, now abandoned.

BACKGROUND OF THE INVENTION

1. Field of the Invention

The present invention relates to a device for binding a shoe or boot on a cross-country ski.

2.Description of Background and Relevant Information

During the practice of cross-country skiing, skiers more and more frequently use a "skater's step" or "skater's half-step" technique. According to this technique the skier moves one of his skis, or alternates each of his skis outwardly so as to apply it against the snow along an acute angle, open towards the front, with respect to the direction of the skier's movement. As a result, at the moment of each rebound towards the front, the skier transfers the weight of his body to his ski inclined towards the outside and he leans on the edge of this ski which is then inclined with respect to the surface of the snow. During this "skater's step" the skier thus exerts on the ski, at the moment of the rebound towards the front, a force which is oriented substantially perpendicular to the support ski, so as to ensure the forward propulsion of the skier.

SUMMARY OF THE INVENTION

The present invention relates to improvements to the system for binding the shoe or boot to the ski sc as to favor movement away from the skier's center of gravity with respect to the support ski and to decrease the rebound force to be exerted by the skier.

In broad terms the invention is directed to a system for binding a shoe or boot onto a cross-country ski. The system comprises an upper support plate movably mounted along a direction having a component which is substantially perpendicular to the ski, and an elastic means for elastically biasing the movable support plate in a direction separating it from the ski.

In a preferred embodiment a binding holding the front of the shoe or boot is mounted on the upper support plate.

Guiding means are provided for guiding and retaining the upper support plate so as to positively effect the trajectory of movement of the movable support plate with respect to the ski during the leaning phase which is accompanied by a compression of the elastic means, and during the rebound phase towards the front which is accompanied by relaxation of the elastic means which contributes to the rebound of the support plate.

According to one embodiment the elastic means comprises a plurality of compression springs extending downwardly from the support plate towards the ski. The compression springs may extend between the support plate and be in contact with the upper surface of the ski, or the springs may extend between the support plate and a base element mounted on the ski.

The springs together have less of a stiffness than the stiffness of the spring blade portion of the ski itself.

The springs may be distributed along at least two longitudinal rows, with corresponding springs from each row being aligned transversely to the longitudinal axis of the ski.

In one embodiment the upper support plate has a vertical and transverse cross-section in the shape of an inverted U comprising an upper horizontal blade extending above the ski and two vertical and lateral wings extending towards the bottom from the longitudinal sides of the blade. The transverse distance between the internal surfaces of the vertical wings is substantially equal to the width of the ski whereby the two vertical and lateral wings are adjacent, at their lower portions, the vertical sides of the ski.

The springs may rest against the upper planar surface of the ski, or be engaged in aligned holes formed in the upper surface of the ski. In this latter case the aligned holes in the upper surface of the ski each constitute a housing for retaining the springs in position.

The guiding means may, in one embodiment, comprise at least one slot provided in each of the two vertical wings of the support plate, and pin means affixed to the ski engaged in the slot means for guiding and retaining the upper support plate. The pin means are solidly affixed to the ski, and the pin means may be pins whose diameter is equal to the width of the slots.

A base element may be used which is adapted to be affixed to the ski with the upper support plate being movably mounted with respect to the base element. The base element may be provided with equidistantly spaced aligned holes arranged along its upper horizontal surface, with the compression springs being positioned in the aligned holes. The base element may have lateral and vertical surfaces having holes bored therein having horizontal and transverse axes adapted to receive pin means extending horizontally and transversely which project laterally through vertical slots formed in the two lateral vertical wings of the upper support plate. The pin means may be affixed in the holes of the lateral and vertical surfaces of the base. When used with a cross-country ski having a longitudinal rib on its upper surface, the base element will have a substantially parallelepipedic shape. The base is flared at its lower portion so as to closely match the contour of the rib of the ski and extends downwardly as far as the upper lateral surface of the ski.

The upper support plate may assume a wide variety of configurations.

In one embodiment the upper support plate comprises a single slot in the middle of each vertical lateral wing, each of the slots being adapted to receive pin means supported by the ski.

In another embodiment the slots of the upper support plate are inclined from the top and bottom and front to rear.

According to another embodiment each of the slots has the shape of an inverted L and comprises a lower vertical section which ends at its upper end in a horizontal section extending towards the front of the ski.

In yet another embodiment the guiding means comprises two slots on each side, each of the two slots having different shapes. On each side there is a front vertical slot, and a rear slot comprising a lower vertical section of the same height as the front slot, and a curve upper section extending from the lower section and having a curvature such that the upper support plate can pivot around the pin means positioned in the front slot once the upper support plate is flattened on the ski.

BRIEF DESCRIPTION OF THE DRAWINGS

The invention will now be described with reference to the annexed drawings, given by way of non-limiting example only, of a number of embodiments of the invention in which.

DESCRIPTION OF PREFERRED EMBODIMENTS

The system according to the invention binds a shoe or boot on a cross-country ski and is characterized in that it comprises an upper support plate on which is mounted a binding holding the front of the shoe or boot. This support plate is mounted for movement along a direction having a component substantially perpendicular to the ski. Elastic means are provided to push the movable support plate away from the ski.

The system also includes means for guiding and retaining the upper support plate so as to positively control the trajectory of movement of the movable support plate with respect to the ski during the support phase which translates into a compression of the elastic means, and during the rebound phase towards the front during which relaxation of the elastic means contributes to the rebound.

Preferably, the elastic means acting on the movable support plate are constituted by a plurality of compression springs extending between the support plate and the upper surface of the ski or an element mounted on the ski.

The guiding means of the elastically mounted movable support plate can be adapted so as to cause a translational movement of the support plate with respect to the ski which occurs entirely in a direction perpendicular to the ski, or alternatively to provide for combined translational movement perpendicular to the ski with another component of translational movement parallel to the ski. According to yet another embodiment, a pivoting movement may be provided with respect to the transverse axis.

The guiding means between the movable upper support plate and the ski can preferably be constituted by at least one slot or groove formed in one of the relatively movable elements, i.e., the upper support plate on the one hand and the ski or an element mounted on the ski on the other hand. A pin, finger or projection supported by one of the elements is engaged in the slot or groove on the other of the elements. The slot or groove may comprise a ramp configured to define the desired parameters of movement for the movable upper support plate.

Figure 1:
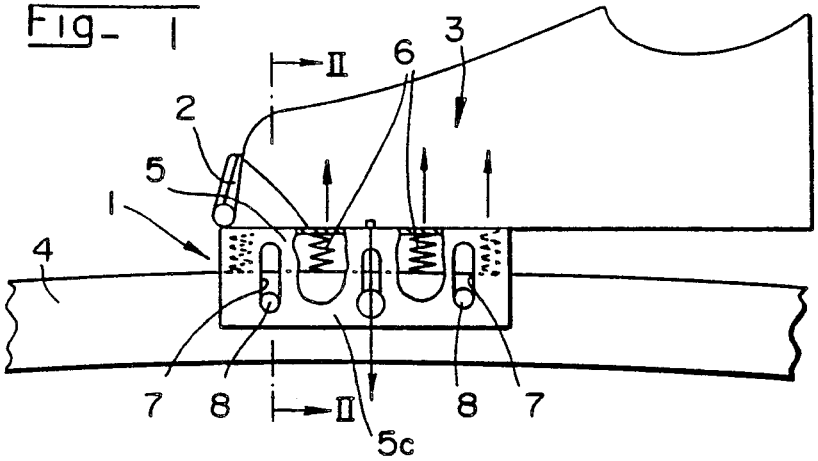
FIG. 1 is a schematic elevation view, with partial cutaway, of a device for binding the front of a shoe or boot on a cross-country ski according to the invention, in the relaxed position after the rebound.
Figure 2:
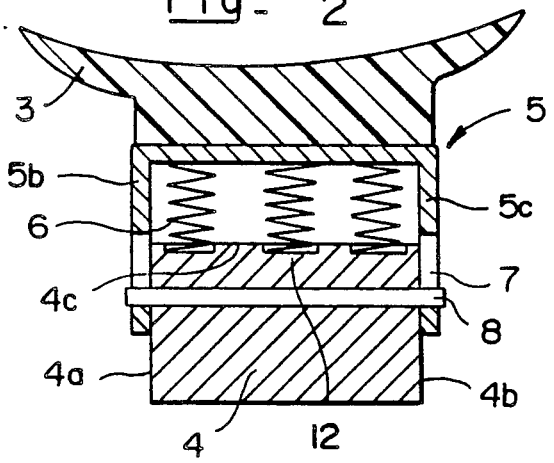
FIG. 2 is an enlarged vertical and transverse cross-sectional view along line II—II of FIG. 1.

The system according to the invention which is shown schematically in FIGS. 1 and 2 and which is designated in its entirety by reference 1, is provided to hold, by means of a schematically shown front binding 2, the front of a shoe or boot 3 on a cross-country ski 4. The expression "front of the shoe or boot" is to be understood as meaning the anterior end of the shoe or boot or the anterior part thereof extending as far as the support zone of the metatarsus. In the example illustrated the cross-country ski is flat, i.e., it has a rectangular vertical and transverse section, but it may likewise have a different cross-section as will be explained below.

System 1 comprises a movable upper support plate 5 which has a vertical and transverse cross-section in the shape of an inverted U. Otherwise stated, support plate 5 includes an upper horizontal blade 5*a*, extending above the ski, and two vertical and lateral wings 5*b* and 5*c* extending downwardly from the longitudinal sides of upper blade 5*a*. The transverse distance between the internal surfaces of the two vertical wings 5*b* and 5*c* is substantially equal to the width of ski 4 so that these two vertical and lateral wings 5*b* and 5*c* are adjacent, in their lower parts, to the two vertical sides 4*a* and 4*b* of ski 4. Upper support plate 5 is elastically mounted on the ski 4 by means of a plurality of small compression springs 6, which are not too stiff and which extend between the upper horizontal surface 4*c* of ski 4 and the lower surface of blade 5*a* of plate 5. Springs 6 are preferably distributed in at least two longitudinal rows, and, for example, in three rows as shown in FIG. 2. In the embodiment shown the individual springs are aligned transversely. Springs 6 can rest on the upper planar surface 4*c* of ski 4, as is shown in the drawing, or in an alternative embodiment they can be respectively engaged in blind holes formed in the upper surface of the ski which function as housings to retain the springs in place. During skiing movable support plate 5 thus yields elastically when pushed back down towards ski 4 by the foot of the skier during each leaning phase, i.e., when the skier exerts pressure with his foot towards ski 4. Springs 6 are then in a compressed state, after which they relax, during the rebound phase, to push support plate 5 back and move it away from the ski, thus contributing to the rebound force.

Movement of support plate 5 with respect to ski 4 is guided by guiding means which are constituted, in this nonlimiting embodiment, by slots 7 which are provided in the two vertical wings 5*b* and 5*c* of support plate 5. Fingers or lugs 8 are engaged in slots 7 and are solidly affixed to ski 4. The diameter of the fingers or lugs is equal to the width of slots 7. In this embodiment lugs 8 are constituted by horizontal and transverse rods or pins which extend completely through ski 4 and which project at their ends with respect to the sides 4*a*, 4*b* thereof, to be engaged in slots 7. Furthermore, the slots extend vertically in wings 5*b* and 5*c*, i.e., perpendicular to the plane of ski 4. There are three slots in each wing spaced longitudinally from one another. As a result, upper support plate 5 is guided so as to perform a translational movement perpendicular to the ski.

Springs 6 are selected so as to have a stiffness which is less than that constituted by the spring blade of ski 4 itself. In effect, in the usual manner, cross-country skis, like racing skis, are arched so as to have in their median portion, a curvature with convexity turned upwardly so that the ski has in this location a certain camber.

Figure 3A:
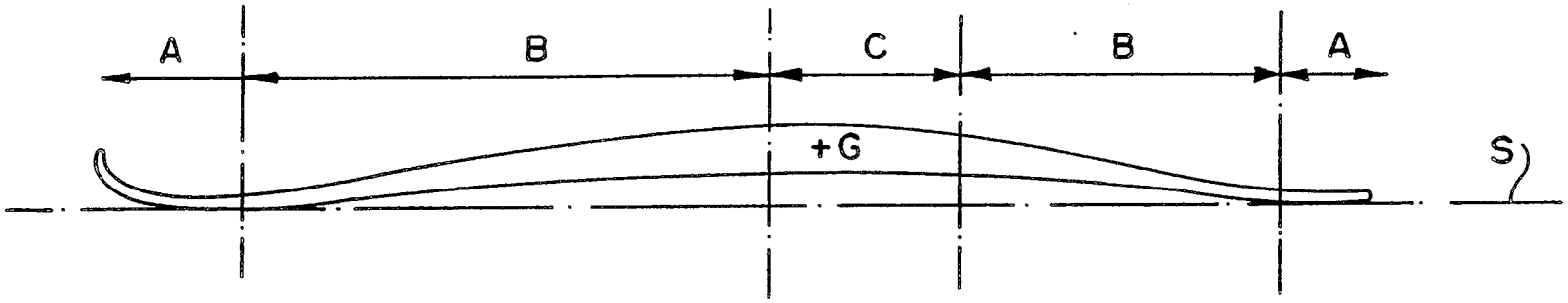
FIG. 3*a* schematically illustrates the various portions of the ski discussed in conjunction with FIG. 3.
Figure 3:
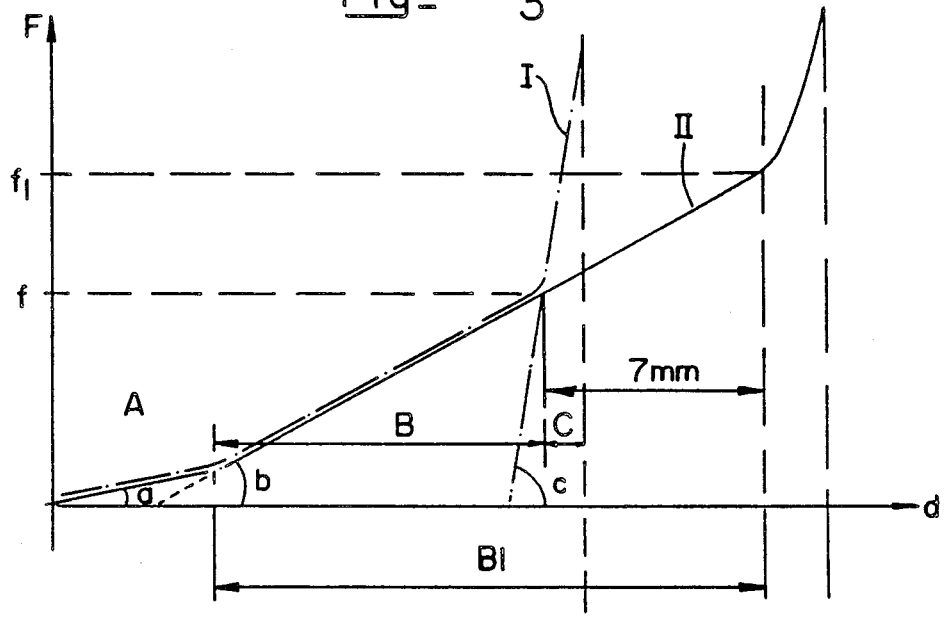
FIG. 3 is a diagram illustrating the influence of the device according to the invention on the value of the rebound force obtained.

The diagram of FIG. 3 illustrates the variation d in elastic strain F of ski 4, considered a spring blade, with respect to the variation d of its curvature or camber.

As may be seen from FIG. 3*a*, the ski itself can be imagined to be divided into three imaginary zones or regions. The two end portions A are in contact with the ground S in the absence of any stress, and have essentially no elastic extent. A substantially central ski portion C, referred to as the central runner, extends to both sides of the center of gravity. The center of gravity of the ski is not in the middle of the length of the ski by virtue of the varying thickness of the ski. Central portion C is the zone of maximum thickness of the ski and is adapted to have the binding mounted thereon. Depending upon the type of ski, this central portion extends to a greater or lesser extent to the rear of the center of gravity G (with respect to the spatula of the ski). This portion C has a substantial rigidity by virtue of its thickness.

The intermediate portions B run between portions A and C. These intermediate portions B have a lesser rigidity than portion C and thus can furnish a certain elastic rebound particularly because there is a relative distance with respect to the ground S.

Returning to FIG. 3, curve I, shown in chain-dotted lines, corresponds to a single ski having a camber in the rest position of 20 millimeters. This curve I includes the three sections A, B, C, of different slopes a,b,c, corresponding to three separate zones of the ski progressively entering into play during the practice of skiing. The first section A corresponds to the end portions of the ski (FIG. 3*a*) where the stiffness of the spring that the ski forms, results in a small slope "a" of the section of curve A, and is too small to provide a rebound. The rear section C corresponds to the central flange whose possible extent is too small and whose stiffness is too significant on snow (very high slope c) to ensure a good rebound. Thus, for the rebound, only each intermediate zone of the ski can be used. This zone is relatively elastic and is between the central runner and an end portion of the ski (section B of the curve of slope or average stiffness b) and in which the useful extent of ski flexion extends over about 10mm of the about 20mm of the total camber. In the case of a single ski one obtains a maximal rebound force "f" corresponding to the maximum flexional extent of about 10mm of the intermediate zone. According to the invention, by adding the springs 6 of lesser stiffness adjacent to the intermediate zone of the ski, one obtains the curve II shown in solid lines and an increase in the useful extent of about 7 millimeters, which is due to springs 6. Otherwise stated, a range of flexion B1 is available having an extent of about 17mm, which is greater than in the preceding case. Thus, with the same ski one obtains a greater rebound force f1, by virtue of the addition of springs 6.

Figure 4:
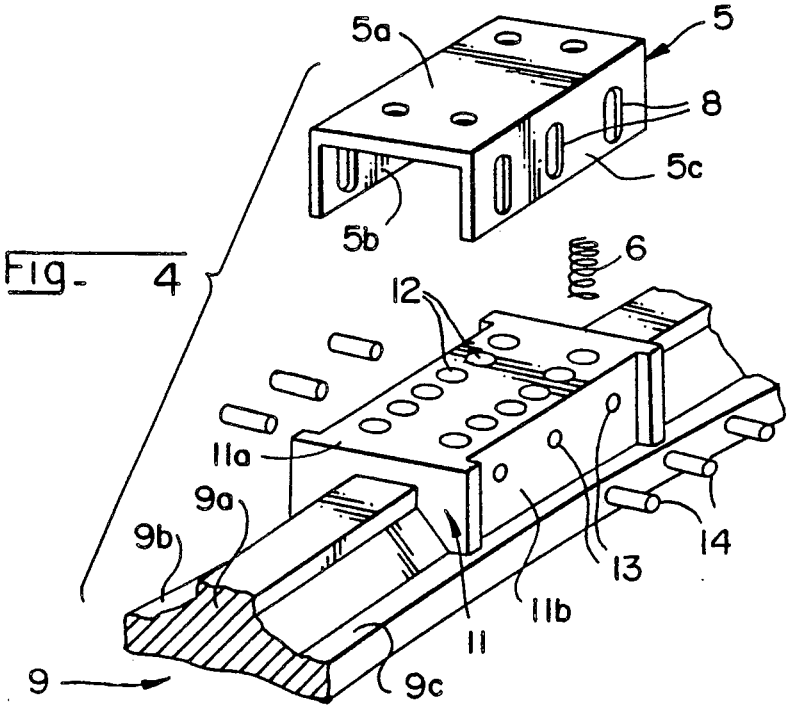
FIG. 4 is a view in exploded perspective of an embodiment of a device according to the invention adapted for use with a cross-country ski having a longitudinal rib on its upper surface.

FIG. 4 illustrates an embodiment of the binding device according to the invention specially adapted to a ski 9 having a longitudinal rib 9*a* on its upper surface. This rib can have a vertical and transverse section with a trapezoidal shape, as is shown in the drawing, or any other appropriate shape. In this embodiment the upper support plate 5 is movably mounted with respect to a base 11 which is affixed to the ski. Base 11 has a substantially parallelepipedic shape and it is flared at its lower portion so as to closely match the contour of rib 9*a* of ski 9, by extending as far as the upper lateral surfaces 9*b* and 9*c* of ski 9. Base element 11 is affixed on ski 9 by any appropriate means, for example, by means of one or more screws (not shown in the drawing). Base element 11 has in its upper horizontal surface 11*a*, equidistantly spaced blind holes 12 in which are positioned compression springs 6 resting under the upper horizontal blade 5*a* of support plate 5. These blind holes are positioned along two longitudinal rows positioned laterally on both sides of the vertical and longitudinal plane of symmetry. As shown by way of example, there are a total of twelve holes. Consequently, the binding device comprises in this case twelve springs 6 distributed in two longitudinal rows of six springs each. Base element 11 also comprises lateral and vertical surfaces 11*b* in which are bored holes 13 of horizontal and transverse axes. Pins 14 are affixed in holes 13. Pins 14 extend horizontally and transversely and project laterally through the vertical slots 8 formed in the two lateral vertical wings 5*b* and 5*c* of movable upper support plate 5. Slots 8 and pins 14 total three in number on each side of the device, however this number is obviously not to be considered as being limiting.

Figure 5:
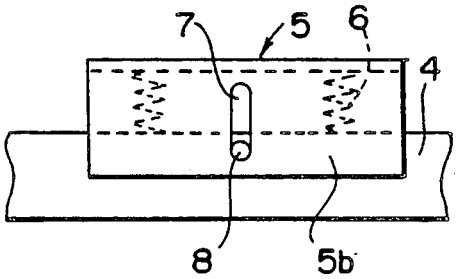

In the alternative embodiment of the invention shown in FIG. 5 upper support plate 5 is provided, in the middle of each lateral vertical wing 5*b* and 5*c*, with a single guiding slot 7 in which is engaged a pin 8 supported by ski 4. As a result, upper support plate 5 can have a combined translational and oscillation movement in the two directions around the horizontal and transverse axis defined by the two coaxial pins 8.

Figure 6:
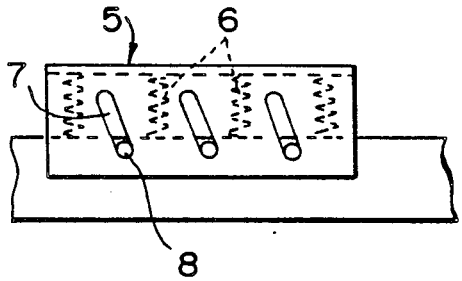
FIGS. 5–8 are elevated schematic views of various alternative embodiments of the binding device.

In the alternative embodiment of the invention shown in FIG. 6 guiding slots 7 of upper support plate 5 are not perpendicular to the ski but rather are inclined from top to bottom and from front to rear, the front of the ski assumed as being on the left in the drawing. As a result, upper support plate 5 can undergo a translational movement having components both in the direction perpendicular to the ski and in the direction parallel to the ski.

Figure 7:
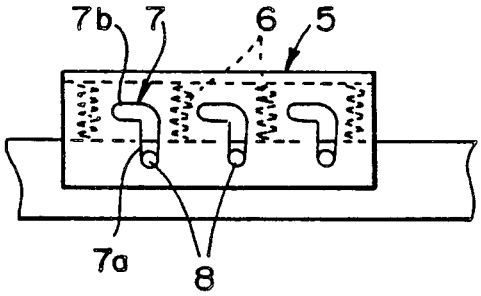

In the alternative of the invention shown in FIG. 7, each guiding slot 7 has the shape of an inverted L and includes a lower vertical section 7*a* which extends at its upper into a horizontal section 7*b* extending towards the front. As a result, upper support plate 5 can first move perpendicular to the ski then parallel thereto, towards the rear.

Figure 8:
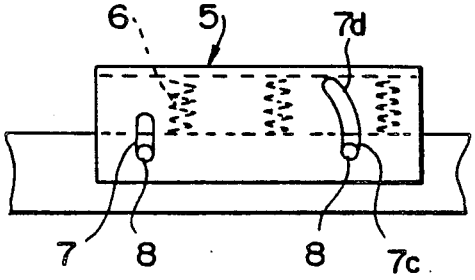

In the alternative embodiment of the invention shown in FIG. 8 support plate 5 comprises on each side, two slots of different shapes, namely a vertical front slot 7 and a rear slot including a lower vertical section 7*c*, of the same height as front slot 7, and an upper curved section 7*d* extending from the lower section 7*c*. Curved section 7*c* has a curvature such that upper support plate 5 can pivot around pin 8 positioned in front slot 7 once the plate 5 is pressed flat on the ski.

Although in all the embodiments of the invention which have previously been described the guidance of movable upper support plate 5 with respect to ski 4 is achieved by means of slots 7 provided in support plate 5 and cooperating with pins, fingers or lugs 8 solidly affixed to ski 4, it goes without saying that the reverse solution can be likewise envisioned. Otherwise stated, ski 4 can be provided, in its sides 4*a* and 4*b*, with grooves in which are engaged inwardly extending pins or lugs supported by vertical and lateral wings 5*b* and 5*c* of movable upper support plate 5. These grooves, forming guide ramps, can also be provided in an element mounted on the ski such as base element 11 of FIG. 4.

Furthermore, the elastic means used to push the movable support plate 56 may be constituted by springs other than compression springs, such as flexion blades, etc....

Finally, although the invention has been described with reference to particular means, materials and embodiments, it is to be understood that the invention is not limited to the particulars disclosed, and extends to all equivalents within the scope of the claims.

We claim:

1. A system for binding a shoe onto a cross country ski, said system adapted to hold a front part of said shoe on said ski, said system comprising: an upper support plate supporting at least said front part of said shoe, at least a part of said shoe rearward of said front part of said shoe being adapted to be supported by a further surface; means for movably and elastically mounting said upper support plate on an upper surface of said ski along a direction having a component which is substantially perpendicular to said ski; said means for movably and elastically mounting being adapted to bias said upper support plate in a direction separating said upper support plate from said ski more greatly than said further surface; said means for elastically biasing providing a rebound force in said direction in a rebound phase following a leaning phase; and means for guiding said upper support plate permitting a translational movement of said upper support plate with respect to said ski in said direction, at least during a beginning of said rebound phase.

2. The system as defined by claim 1, wherein said front part of said shoe extends as far as a support zone of the metatarsus.

3. The system as defined by claim 1, wherein a binding holding the front of said shoe is mounted on said upper support plate.

4. The system as defined in claim 1, wherein said means for guiding said upper support plate is adapted so as to guide the trajectory of movement of said upper support plate along said direction with respect to said ski during said leaning phase which is accompanied by a compression of said elastic means, and during said rebound phase towards the front which is accompanied by relaxation of said elastic means which contributes to the rebound of said support plate.

5. The system as defined by claim 4, wherein said elastic means comprise a plurality of compression springs extending downwardly from said support plate towards said ski.

6. The system as defined by claim 5, wherein said compression springs extend between said support plate and are in contact with the upper surface of said ski.

7. The system as defined by claim 5, wherein said springs extend between said support plate and a base element mounted on said ski.

8. The system as defined by claim 5, wherein stiffness of said springs is less support zone of the metatarsus, said system comprising: an upper support plate supporting said front part of said boot; means for movably and elastically mounting said upper support plate on an upper surface of said ski along a direction having a component which is substantially perpendicular to said ski; means for elastically biasing said upper support plate in a direction separating said upper support plate from said ski; said means for elastically biasing providing a rebound force in said direction in a rebound phase following a leaning phase; and means for guiding said upper support plate permitting a translational movement of said upper support plate with respect to said ski in said direction, at least during a beginning of said rebound phase.

9. The system as defined by claim 5, wherein said springs are distributed along at least two longitudinal rows, with corresponding springs from each row being aligned transversely to the longitudinal axis of said ski.

10. The system as defined by claim 5, wherein said springs rest against an upper planar surface of said ski.

11. The system as defined by claim 5, wherein said springs are engaged in aligned holes formed in the upper surface of said ski, said aligned holes in the upper surface of said ski each constituting a housing for retaining said springs in position.

12. The system as defined by claim 1, wherein said upper support plate has a vertical and transverse cross-section in the shape of an inverted U comprising an upper horizontal blade extending above said ski and two vertical and lateral wings extending towards the bottom from the longitudinal sides of said blade.

13. The system as defined by claim 12, wherein the transverse distance between the internal surfaces of said vertical wings is substantially equal to the width of said ski whereby said two vertical and lateral wings are adjacent, at their lower portions, the vertical sides of said ski.

14. The system as defined by claim 12, wherein said guiding means comprises at least one slot provided in each of said two vertical and lateral wings of said support plate, and pin means affixed to said ski engaged in said slot means for guiding and retaining said upper support plate.

15. The system as defined by claim 14, wherein said pin means are solidly affixed to said ski, and wherein said pin means are pins whose diameter is equal to the width of said slots.

16. The system as defined by claim 15 further comprising a base element adapted to be affixed to said ski, and wherein said upper support plate is movably mounted with respect to said base element.

17. The system as defined by claim 16, wherein said base element has equidistantly spaced aligned holes arranged along its upper horizontal surface, and wherein compression springs are positioned in said aligned holes.

18. The system as defined by claim 17, wherein said base element comprises lateral and vertical surfaces having holes bored therein having horizontal and transverse axes adapted to receive pin means extending horizontally and transversely which project laterally through vertical slots formed in the two lateral vertical wings of said upper support plate.

19. The system as defined by claim 18 wherein, said pin means are affixed to said ski through said holes of the lateral and vertical, surfaces of said base.

20. The system as defined by claim 16, wherein said ski has a longitudinal rib on its upper surface, and wherein said base element has a substantially parallelepipedic shape, said base being flared at its lower portion so as to closely match the contour of said rib of said ski and extending downwardly as far as the upper lateral surface of said ski.

21. The system as defined by claim 14, wherein said upper support plate comprises a single slot in the middle of each vertical lateral wing, each of said slots adapted to receive pin means supported by said ski.

22. The system as defined by claim 14, wherein said slots of said upper support plate are inclined from the top and bottom and front to rear.

23. The system as defined by claim 14, wherein each of said slots has the shape of an inverted L and comprises a lower vertical section which ends at its upper end in a horizontal section extending towards the front of said ski.

24. The system as defined by claim 14, wherein said guiding means comprises two slots on each side, each of said two slots having different shapes.

25. The system as defined by claim 24, wherein on each of said sides there is a front vertical slot, and a rear slot comprising a lower vertical section of the same height as said front slot, and a curved upper section extending from said lower section and having a curvature such that said upper support plate pivots around the pin means positioned in said front slot once said upper support plate is flattened on said ski.

* * * * *